US006971308B2

(12) United States Patent
Severino

(10) Patent No.: US 6,971,308 B2
(45) Date of Patent: Dec. 6, 2005

(54) PRINTING DEVICE FOR PRINTING MACHINES OF VARIOUS KIND

(75) Inventor: Masiero Severino, Saonara (IT)

(73) Assignee: Meccanica Masi, Camin (IT)

( * ) Notice: Subject to any disclaimer, the term of this patent is extended or adjusted under 35 U.S.C. 154(b) by 0 days.

(21) Appl. No.: 10/476,308

(22) PCT Filed: Dec. 12, 2002

(86) PCT No.: PCT/EP02/14146

§ 371 (c)(1),
(2), (4) Date: Oct. 29, 2003

(87) PCT Pub. No.: WO03/051633

PCT Pub. Date: Jun. 26, 2003

(65) Prior Publication Data

US 2004/0144269 A1 Jul. 29, 2004

(30) Foreign Application Priority Data

Dec. 14, 2001 (IT) ..... PN2001A0088
Sep. 13, 2002 (IT) ..... PN2002A0066
Sep. 13, 2002 (IT) ..... PN2002A0067

(51) Int. Cl.[7] ..... B41F 7/02
(52) U.S. Cl. ..... 101/217; 101/179
(58) Field of Search ..... 101/179, 180, 101/182, 184, 216, 217, 218, 247, 389.1

(56) References Cited

U.S. PATENT DOCUMENTS 4,290,353 A * 9/1981 Pav et al. ..... 100/162 B
5,392,702 A * 2/1995 Suzuki ..... 100/163 R
5,782,177 A * 7/1998 Rindfleisch ..... 100/334
5,901,893 A 5/1999 Furlani et al.
6,034,457 A * 3/2000 Furlani et al. ..... 310/103

FOREIGN PATENT DOCUMENTS

EP 0 021 297 A 7/1981

* cited by examiner

*Primary Examiner*—Ren Yan
(74) *Attorney, Agent, or Firm*—Bucknam and Archer

(57) ABSTRACT

Printing device for printing machines of various kind, which is made in such a way that to permit to print paper pages and sheets of any size, with a number of copies larger than those attainable with the current printing machines and with high printing accuracies. Printing device comprising a plurality of cylinders having at least a double height, including cauotchouc-covered printing cylinders (10, 11), which are magnetically attracted with each other during the printing process, thereby preventing any undesired mechanical vibration of the same cylinders, which could be prejudicial for the printing quality, and cylinder-plates (16, 17) which are attracted by the opposite printing cylinders during the printing process, and which are covered with a number of printing plates identical to the number of copies of paper pages and sheets to be printed. The invention also discloses other particular component parts of this printing device.

16 Claims, 16 Drawing Sheets

PRINTING DEVICE FOR PRINTING MACHINES OF VARIOUS KIND

CROSS REFERENCE TO RELATED APPLICATIONS

Applicant claims priority under 35 U.S.C. §119 of Italian Patent Application No. PN2001A000088 filed Dec. 14, 2001, Italian Patent Application No. PN2002A000066 filed Sep. 13, 2002, Italian Patent Application No. PN2002A00067 filed Sep. 13, 2002. Applicants also claim priority under 35 U.S.C. §365 of PCT international application No. PCT/EP02/14146 filed Dec. 12, 2002. The PCT international application was published in English.

The invention relates to a printing device for printing machines of various kind, and particularly but not exclusively offset printing machines, which is made in such a way as to print paper sheets and pages of any size, with high printing numbers and accuracies of the employed printing machines.

At the present, the printing machines of various kind which are used to print paper pages and sheets for newspapers, magazines etc . . . comprise groups of machines of the same kind which are associated to each other, and arranged to print successively such paper pages and sheets on both sides thereof and which are formed by a set of cylinders arranged approached to and co-operating with each other and supported by a rigid support structure, constituted generally by a pair of metallic cylinder-plates supporting the compositions of the printing types, a set of ink-applying rollers covered by rubber or ceramic which receive the ink contained into adequate containers and are into contact with such cylinder-plates, so as to transfer the ink on to the outer surface of the same cylinder-plates, by a set of possible applying rollers which are receiving the aqueous solution contained into particular aqueous solution containers and into contact with such cylinder-plates, so as to ink these latter, and finally by a pair of caoutchouc-covered metallic printing cylinders which are into contact with each other and with such cylinder-plates, so as to receive continuously from these latter the inked compositions of the printing types and to print respective copies of the paper pages and sheets being passing through the area of reciprocal contact between such printing cylinders, by means of suitable transmission mechanisms mounted on to the rigid support structure of the respective printing machine. All these cylinders are made with the same length, such that to permit to print paper pages and sheets having pre-established maximal sizes for the entire extent thereof, and during the printing process the printing cylinders are driven in rotation with the above mentioned transmission mechanisms, with rotation directions which are reverse to each other and pre-established speeds, so as to allow to print number of copies/hour enough to be economically advantageous. Moreover, such cylinders are kept pushed toward each other by suitable mechanical members associated with such transmission mechanisms, for printing the paper pages and sheets in an uniform manner and with sufficient pressures to provide for an effective printing. In particular, these printing cylinders are driven in rotation with maximal speeds which cannot exceed established limits, such that to ensure on the one hand to print a number of copies which is economically profitable and on the other hand to avoid that undesired mechanical vibrations on the cylinders occur, which could change the reciprocal pressure thereby jeopardizing the print quality and the operation and stability of the printing machines. The object of the present invention is to overcome the drawbacks and limitations of the current printing machines, by means of the printing device according to the invention, which is mounted on the printing machines so as to allow to print numbers of copies/hour of paper pages and sheets which are considerably higher than those currently obtained, without originating vibrations on the same cylinders, and ensuring a high print quality.

Other objects of the present invention are to provide for a printing device with such characteristics that to improve the performances of the printing machines.

This printing device is made with the constructive characteristics substantially described, with particular reference to the enclosed claims of the present patent.

The invention will be better understood from the following description, given solely by way of not-limitative example and with reference to the accompanying drawings, in which.

Figure 1:
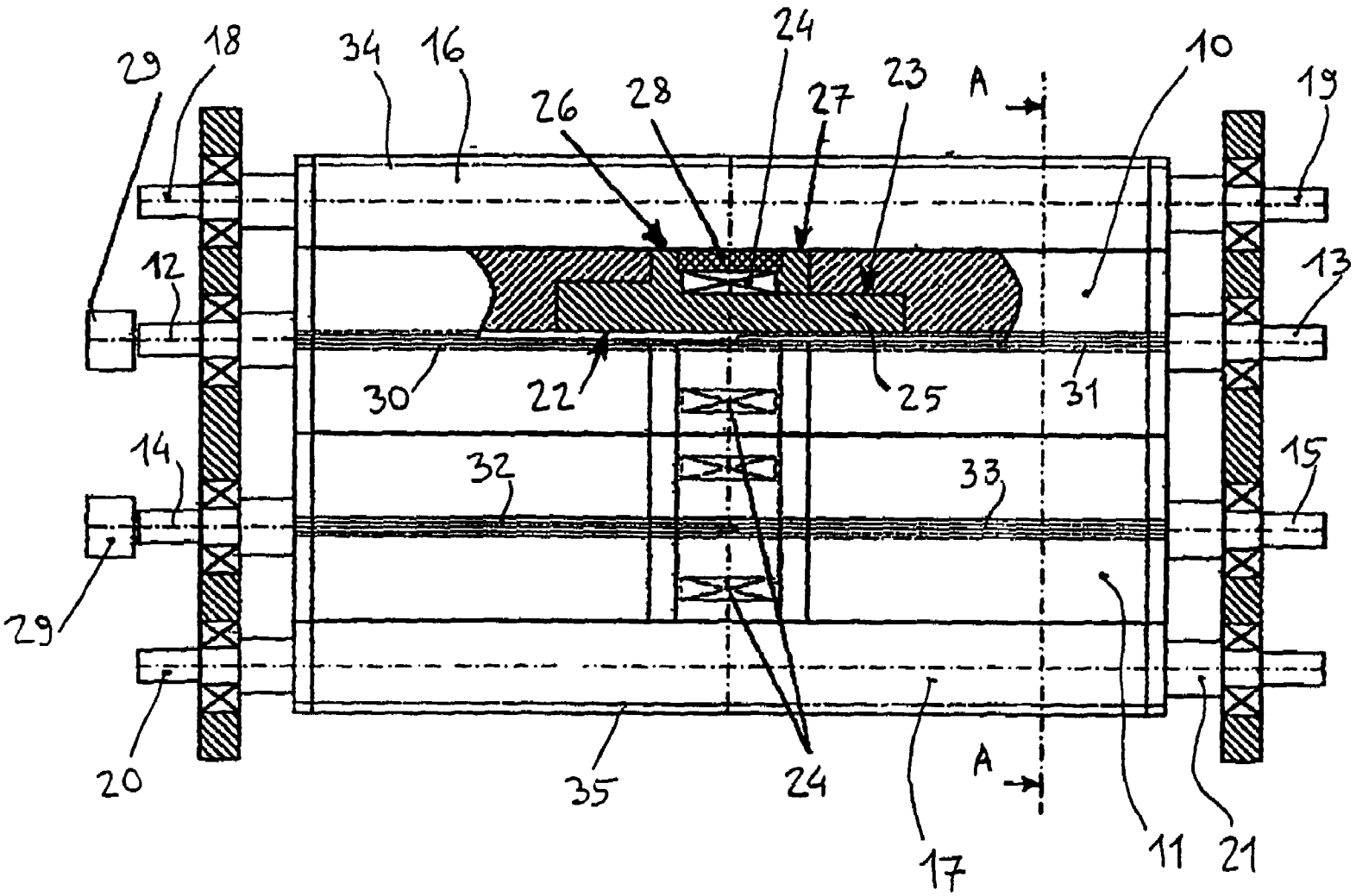
FIG. 1 shows a partially cutaway schematic front view of the printing device in accordance to the invention, in a first embodiment thereof.

The above mentioned Figures schematically illustrate a printing device according to the invention,adapted to be fitted into printing machines of various kind, and particularly but not exclusively offset printing machines, which is made in such a manner that to print paper pages and sheets of any size, on both the sides thereof, with high numbers of copies and accuracies of printings of the used machines. This printing device is constituted substantially by a set of cylinders mounted on to the rigid support structure (not indicated) of each printing machine of conventional kind, such cylinders being all of at least double height and co-operating with each other and being made in the manner hereinafter described. In the FIGS. 1 and 2, in particular, in which the present printing device in a first embodiment thereof is shown, it is noted that it is constituted by a pair of caoutchouc-covered metallic printing cylinders 10 and 11 arranged into reciprocal contact in the manner which will be described, so as to allow the paper pages and sheets to be printed to pass therethrough, which are supported by means of relative side shafts 12, 13 and 14, 15 on to the printing machine support structure and are driven in rotation by transmission mechanisms of conventional type (not shown), provided in the associated printing machine, with rotation directions reverse with each other and with maximal rotation speeds of about 40,000 rpm, such printing cylinders being identical and made both with large diameter, like that of the cylinders mounted in the current printing machines.

Moreover, this printing device is constituted by a pair of metallic cylinder-plates 16 and 17 of conventional type, which are supported by means of relative side shafts 18, 19 and 20, 21 on to the printing machine support structure, on a position opposite with respect to the relative printing cylinder 10 and 11, on a position axially aligned with each other and with such printing cylinders, and on different positions, for example on the positions indicated with dashed line with the reference numerals 16*a* and 16*b* and 17*a* and 17*b*, these cylinder-plates being kept into close contact with the corresponding printing cylinders by utilizing the thrust mechanisms associated with the transmission mechanisms and them and the present printing device are also into contact with the ink applying rollers covered with rubber or ceramic, which receive the ink contained into proper container for transferring the ink on to the outer surface of the same cylinder-plates.

Finally, such cylinder-plates are into contact also with a set of possible applying rollers receiving the aqueous solution contained on proper containers, for being inked.

Figure 2:
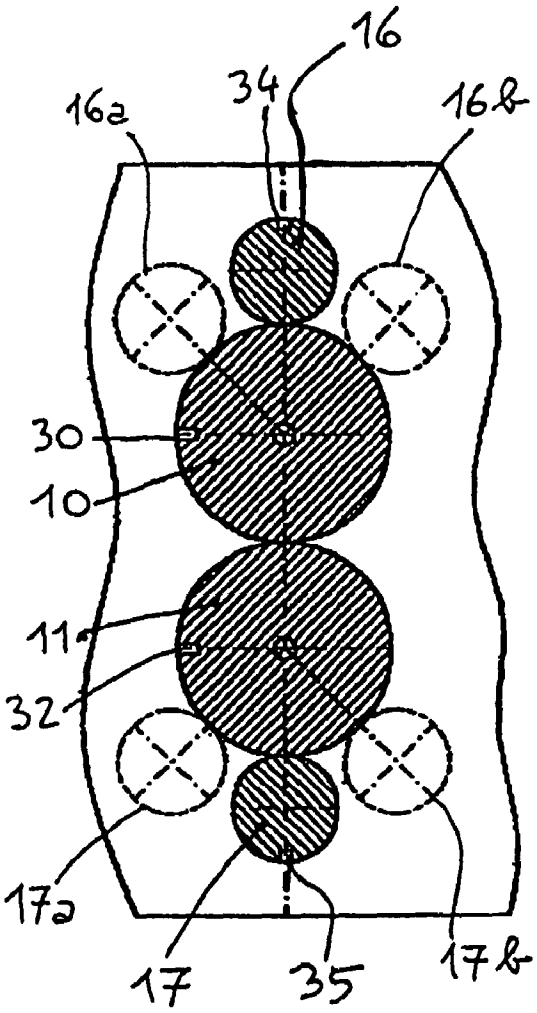
FIG. 2 shows a schematic side view of the printing device of FIG. 1, cutaway along the line A—A.

As visible particularly on FIG. 1, each caoutchouc-covered printing cylinder 10 and 11 is made with an inner cavity 22 extended for the entire length or part of the length thereof, in which at least a magnetic core 23 adequately shaped and dimensioned is housed, which is made with magnetic material such as hardened and tempered steel type C 40 or nickel-chrome-molybdenum 4 compound steel type C 39, or other suitable material adapted to allow the temporary magnetization of the magnetic core and its subsequent de-magnetization. Advantageously, as magnetic material is used the so-called electro-permanent material, namely a magnetic material used in commerce which can be magnetized and de-magnetized and which, under the magnetized condition, remains always on this condition and does not de-magnetize at any event which may occur, such as for example voltage losses or failures on the coil wound around the same magnetic material. Such a kind of material can be manufactured for example by the Firm S.P.D. S.p.A. of Caravaggio (BG), Italy, and is known with the trade name Elettropermanente, but of course it may be manufactured also by different Firms and with different names and constructive characteristics thereof, provided that it permits always that the same functions are performed.

Besides, this magnetic core 23 is associated with one or more electric coils 24 connected to a relative machine electric circuit, which are connected or disconnected in the manner which will be described later on, in order to provide for respectively the temporary magnetization and the de-magnetization of the magnetic core 23, for the reasons set forth below. In the present case, by way of example only, the magnetic core is made with the form of a lengthened cylindrical block 25 occupying the central inner zone of the inner cavity 22 and is shaped with at least a pair of magnetic pole shoes 26 and 27, forming the north and south poles (or the south or north poles, depending on the magnetization direction of the magnetic core), which are spaced away axially from each other, thereby defining a free space for housing one or more circular shaped electric coils 24 to magnetize the same core, such pole shoes being projected slightly and radially outwards, and being then covered by the covering caoutchouc (not indicated) of the associated printing cylinder. An annular part 28 of diamagnetic material of conventional type is then applied on to the coil (s) 24 housed as described, for the entire extent thereof, which has the function to insulate a polarity of the magnetic core from the other one, thereby permitting the generated magnetic flux to be closed along a path passing through the magnetic core 23, the two magnetic poles 26 and 27 and the coil (s) 24. Such coil (s) 24 are supplied by an electric voltage through electric conductors (not shown) which are passing through the inner cavity 22 and are connected to a rotating conductor device such as for example a mercury device 29, fitted at one end portion of one of the side shafts of the corresponding printing cylinder, in the present example the shaft 12 of the printing cylinder 10 and the shaft 14 of the printing cylinder 11, wherein each one of such electric conductors is connected to the printing machine electric circuit and the coils of the two printing cylinders 10 and 11 are supplied by an electric voltage at determinate intervals by means of adequate control devices connected to the relative electric circuit, thereby permitting to magnetize or de-magnetize the magnetic cores on the desired moments.

Furthermore, the magnetic cores 23 of both the printing cylinders 10 and 11 can be magnetized in such a way as to be attracted toward each other, thereby providing for a reciprocal attraction between the same cylinders and the magnetic attraction force is selected in such a manner to keep these printing cylinders always closely adherent with each other, above all at the central zone thereof which is the more critical, thereby determining at the one hand an effective printing of the paper pages and sheets being passing through the contact zone of the same cylinders, and on the other hand preventing that these cylinders may be submitted to high stresses, and mechanical deflections and vibrations when they are driven in rotation at the foreseen high speeds. This may be obtained by arranging the magnetic cores internally the associated printing cylinder in a manner that their polarities are opposite to each other, or by providing their coils 24 with their windings wound in the same direction, and by reversing the electric current circulating direction in the two cylinders 10 and 11, or by providing such coils with their windings wound in directions opposite from each other and circulating the electric current in the same direction through both the coils. It is to point out that the presence of the magnetic poles does not provide for undesired heatings of the cylinders, so that a high quality of the printing process can be always attained. Moreover, instead of a pair of magnetic poles only, also additional pairs of magnetic poles having different forms, sizes and magnetic field intensities can be utilized, and such poles can be arranged on different positions so as to provide for the magnetic field along the cylinder on different axial and radial positions thereof.

Figure 4:
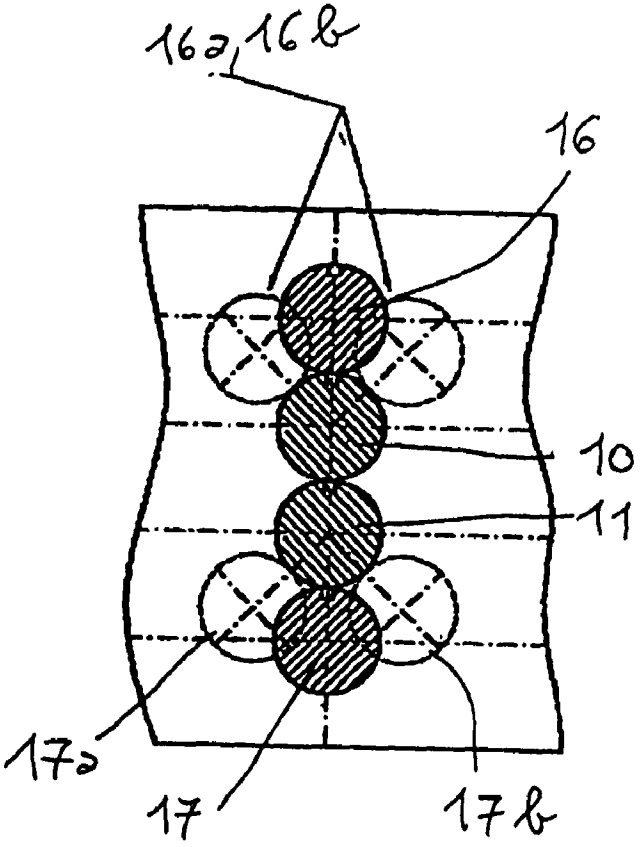
FIG. 4 shows a schematic side view of the printing device of FIG. 3, cutaway along the line B—B.
Figure 3:
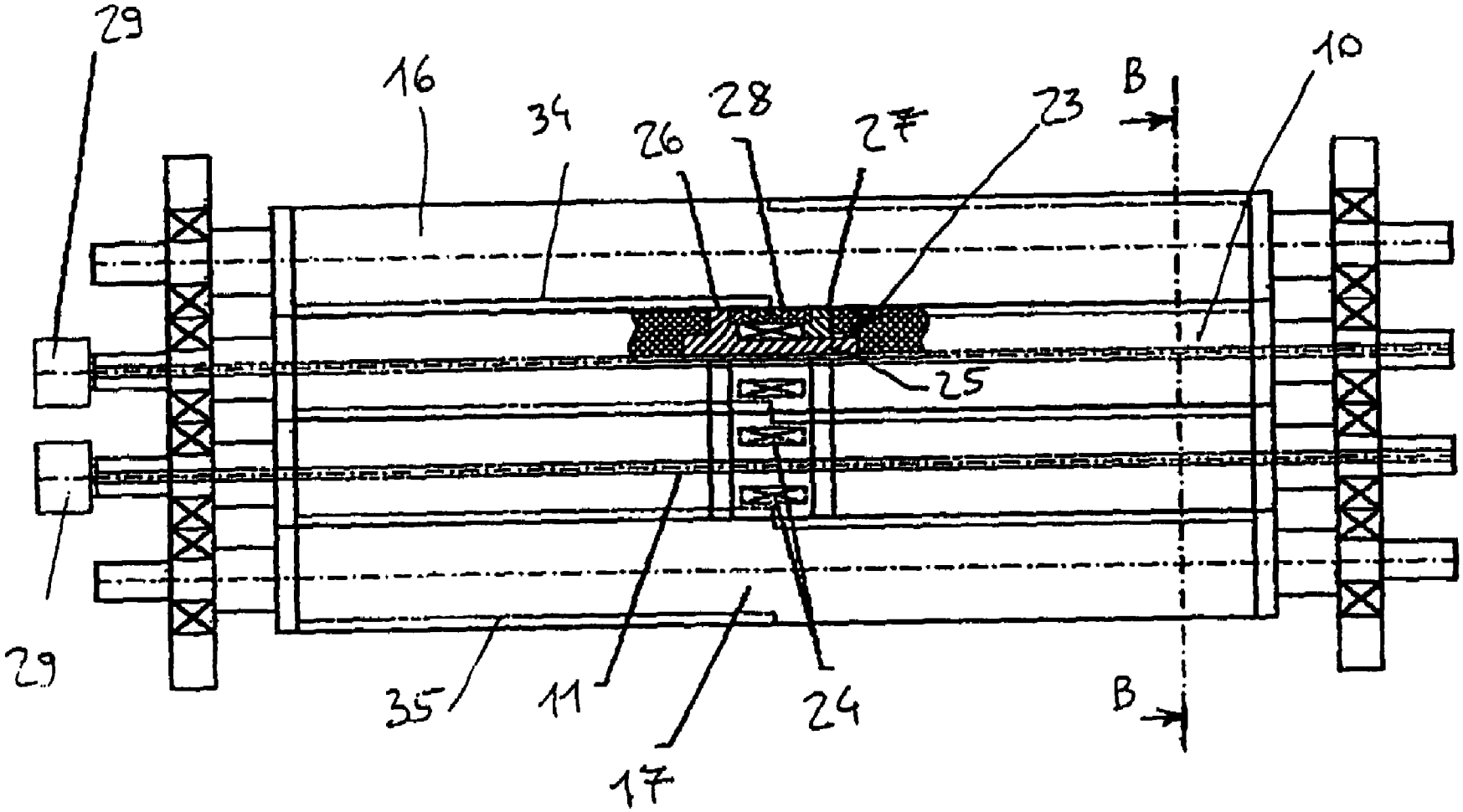
FIG. 3 shows a partially cutaway schematic front view of the present printing device, in a constructive variant thereof.
Figure 5:
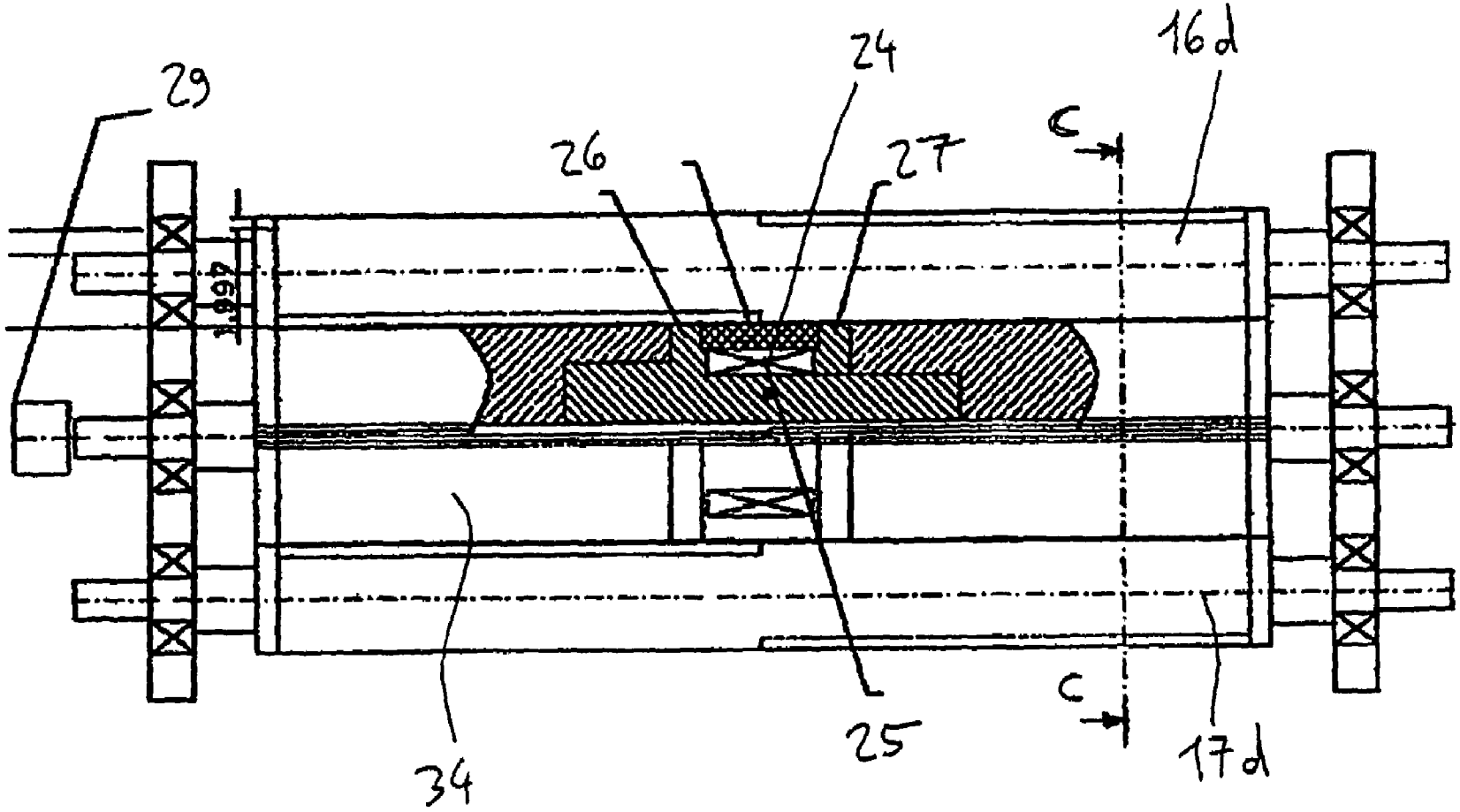
FIG. 5 shows a partially cutaway schematic front view of the present printing device, in a second embodiment thereof.
Figure 6:
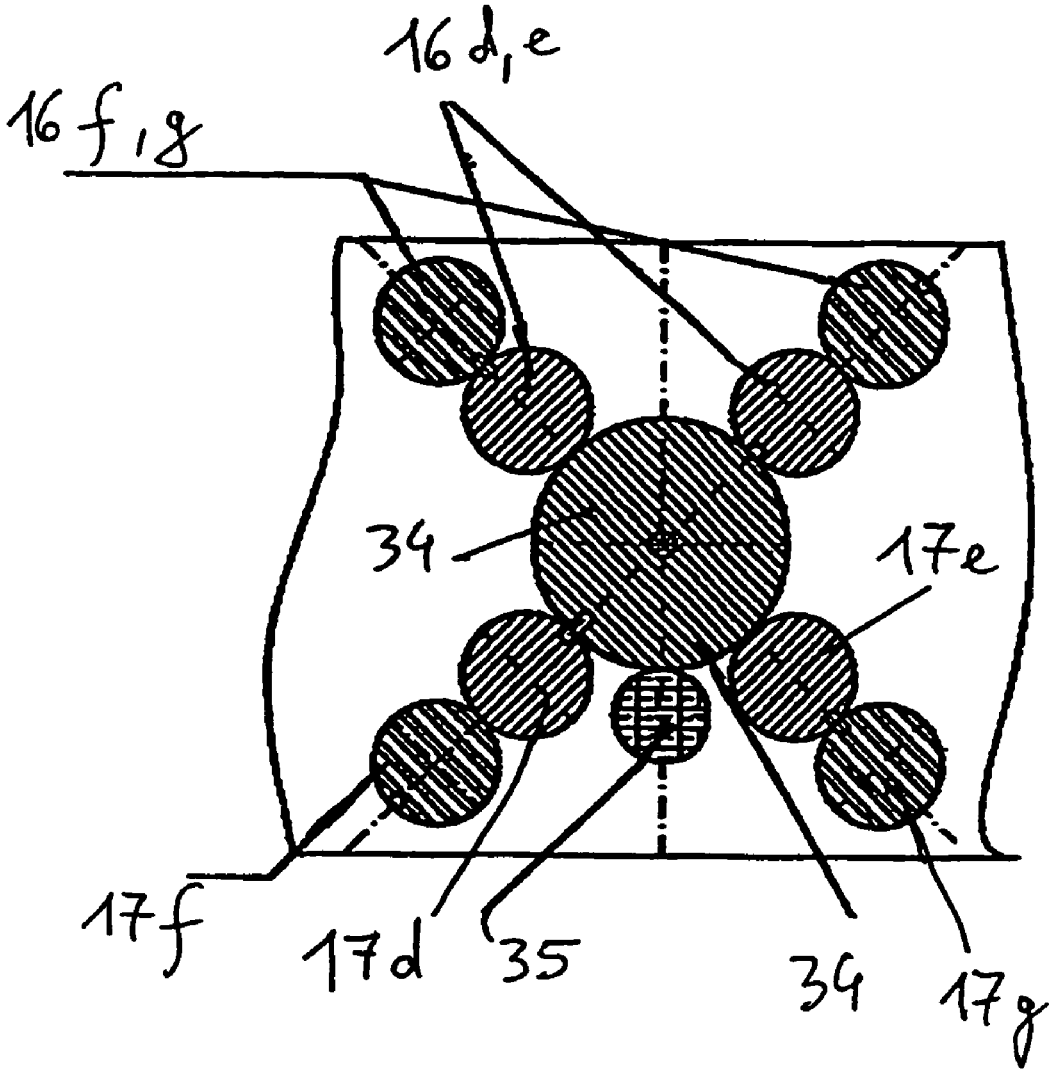
FIG. 6 shows a schematic side view of the printing device of FIG. 5, cutaway along the line C—C.
Figure 7:
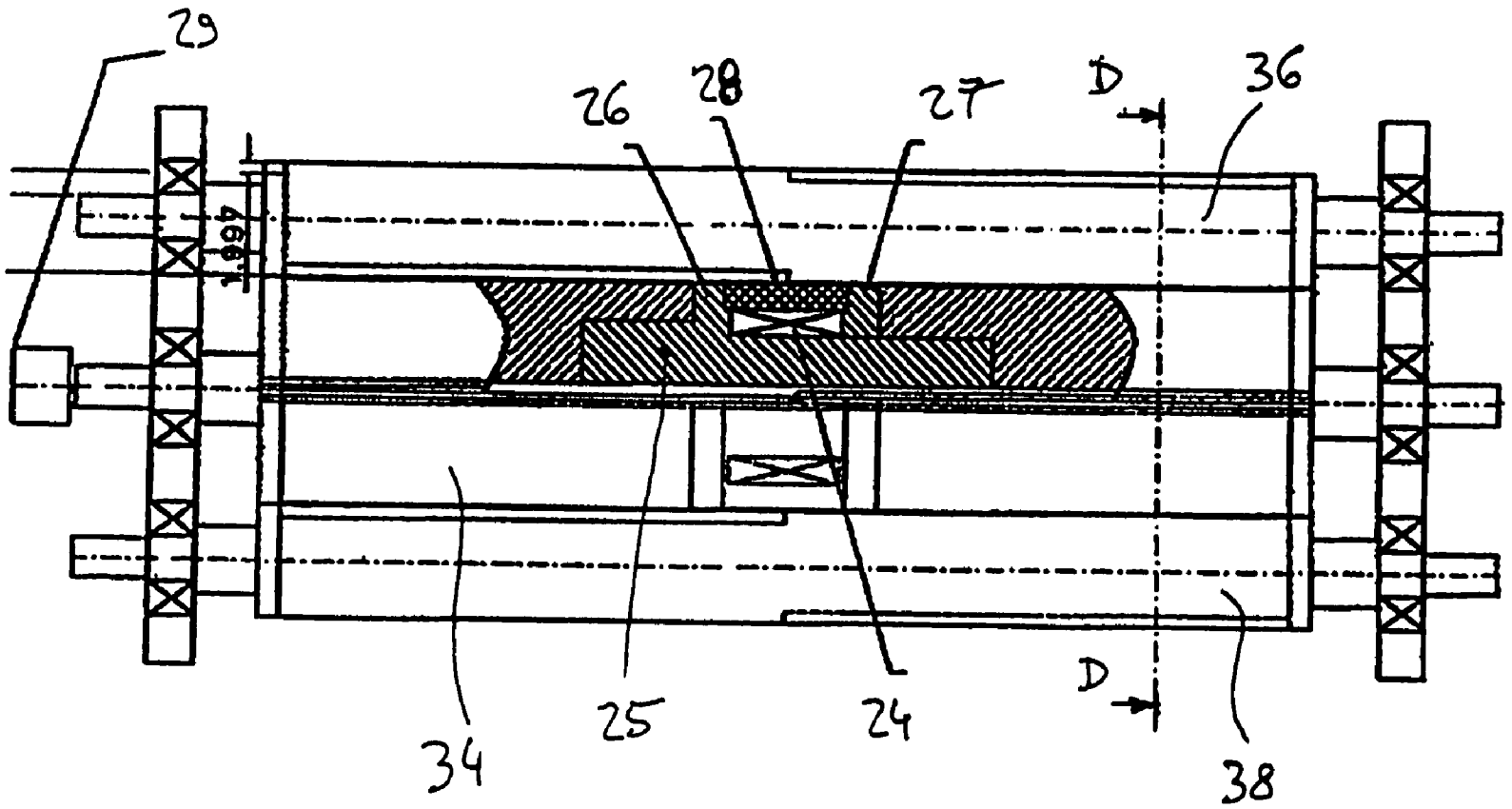
FIG. 7 shows a partially cutaway schematic front view of the printing device in accordance to the invention, in a third embodiment thereof.
Figure 8:
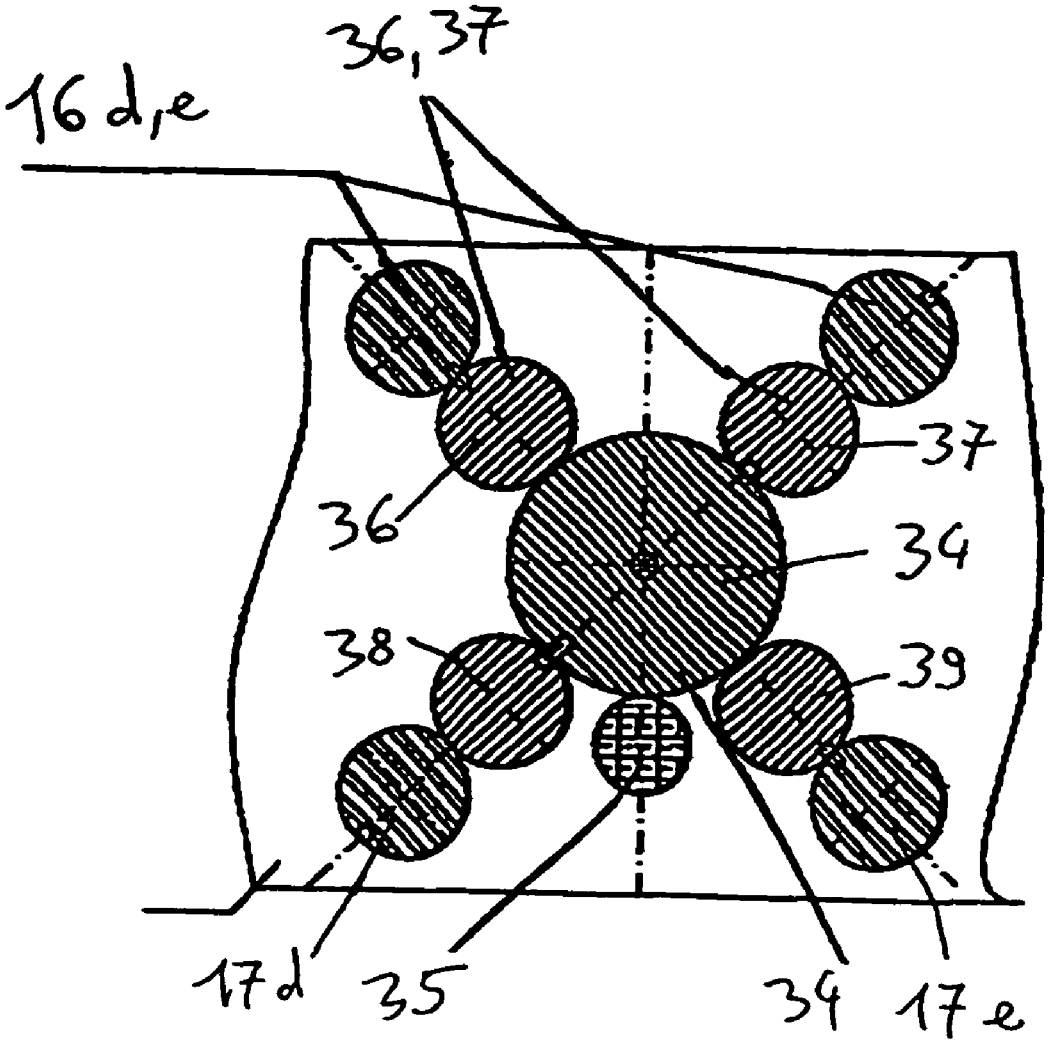
FIG. 8 shows a schematic side view of the printing device of FIG. 7, cutaway along the line D—D.

In turn, the printing cylinders 10 and 11 provide for, when the relative magnetic cores 23 are magnetized, a reciprocal attraction of the opposite cylinder-plates 16 and 17 which are made of metallic material and are into contact against such printing cylinders, with consequent close adhesion of these cylinder-plates against the associated printing cylinders, for the same reasons as above. The assembling on position of these component parts on the relative printing cylinders is effected by introducing into the corresponding inner cavity, from one of its side end portions, the corresponding magnetic core onto which its own coil with the associated annular part has been arranged, and then by connecting the electric conductors of this coil with its own rotating conductor device. In turn, each covering made of caoutchouc is applied on to the outer surface of said printing cylinders preferably by providing each covering with two identical portions, whose length is the half of that of the entire covering, and by hooking the free ends of one portion into a corresponding groove 30, 32 provided externally the relative cylinders 10 and 11, for a half-length thereof, and the free ends of the other portion into a corresponding groove 31, 33 provided externally the same cylinders, for the other half-length thereof, and offset of almost 180° with respect to the preceding groove. In this way, during the rotation of the printing cylinders, the two half-grooves of a cylinder come into contact with a single half-groove of the other cylinder, so that the continuous contact between such cylinders occurs in a soft manner with minima mechanical vibrations and stresses, which would be higher if the grooves come into contact with each other entirely. Besides, each cylinder-plate 16 and 17 is covered with a number of plates identical to the number of pages and sheets to be printed. In this way, it isn't more necessary to apply on to each cylinder-plate two plates for each page or sheet to be printed, as it currently occurs, rather it is sufficient to apply one single plate only, since such cylinder-plate keeps always an effective contact with the printing cylinder adjacent thereto, thanks to the reciprocal attraction between the same cylinders, at any rotation speed of such cylinders. As a consequence, with the same number of printed copies of pages or sheets it is obtained a saving of plates employed for such printing process, with remarkable advantages of lower quantities of employed materials and cost burdens for manufacturing, assembling and managing the plates with respect to the current printing machines. Thus, it appears evident that, besides of involving the above mentioned remarkable advantages, the printing device according to the invention allows, with the same rotation speed of the cylinder-plates, to print a double number of copies of paper pages and sheets, having all the existing sizes, with respect to the current printing machines, thanks to the presence of the cylinder-plates having at least a double height and simple development, which permit to apply a double number of plates, even different to each other, thereby increasing considerably the printing productivity and uniformity, with consequent better quality of the same printing.With reference now to FIGS. 3 and 4, in which a constructive variant of the printing device of the previous Figures is illustrated, it is noted that such device is substantially constituted in the same manner than the preceding one, and differs therefrom only in that in this case the printing cylinders 10 and 11, which are always provided with the relative magnetic core 23 operating in the same manner and for the same scopes and with the same advantages as described, have the same diameter of the cylinder-plates 16 and 17, and therefore allow, thanks to the lower diameter of the printing cylinders, to reduceconsiderably the overall dimensions in the height of the printing groups obtained by combining together different printing machines of this kind, as well as to halve the number of printing groups currently needed to print the same number of copies of paper pages and sheets. FIGS. 5 and 6 now show a second embodiment of the present printing device, which in this case has a central cylinder 34 made of metallic material with outer smooth surface acting as an abutment, and a series of cylinders having the compositions of types made with a larger number and a satellite-like arrangement distribution around such central cylinder 34, which may be or may not be offset from each other of the same angular distance and are into contact with the central cylinder. In this case, there are provided four satellite-like arranged cylinders 16*d, e* and 17*d, e*, which, depending on the kind of printing machine on to which they are assembled, are shaped like plate carrying cylinders or copper plated cylinders with engraved writings, the one of which is provided for black and white printing and the other three cylinders are provided for printing in sequence on the same position the respective main colours red, yellow and blue. In turn, such cylinders are into contact with corresponding anylox cylinders made of ceramic 16*f, g* and 17*f, g*, which are distributed in the same manner and provided for transferring the printing ink on to the respective adjacent cylinders. Moreover, also a further idle rotating cylinder 35, into contact with the central cylinder 34 is provided, which is situated on a position moved away with respect to the existing plate carrying or copper plated cylinders, and which is provided with an own magnetic core (not shown) which can be supplied with a voltage autonomously so as to magnetize and de-magnetize the same central cylinder and also such plate carrying or copper plated cylinders. Such further idle magnetic cylinder 35 may be replaced also by any other magnetic bodyshaped in different manners, arranged into contact with the central cylinder 34 at any position around it and performing the same function thereof. Finally, FIGS. 7 and 8 show a third embodiment of the present printing device, in which also in this case there are provided a metallic central cylinder 34, a possible additional idle cylinder 35 and four cylinder-plates 16*d, e* and 17*d, e* distributed in a satellite-like arrangement around the central cylinder 34, always for the polychromy printing like the FIGS. 5 and 6, however here the cylinder-plates are into contact with the same number of printing cylinders 36, 37, 38 and 39, provided respectively for black and white printing and printing the three main colours red, yellow and blue perfectly overlapped among them, and in turn these latter are into contact with the central cylinder34.

Figure 9:
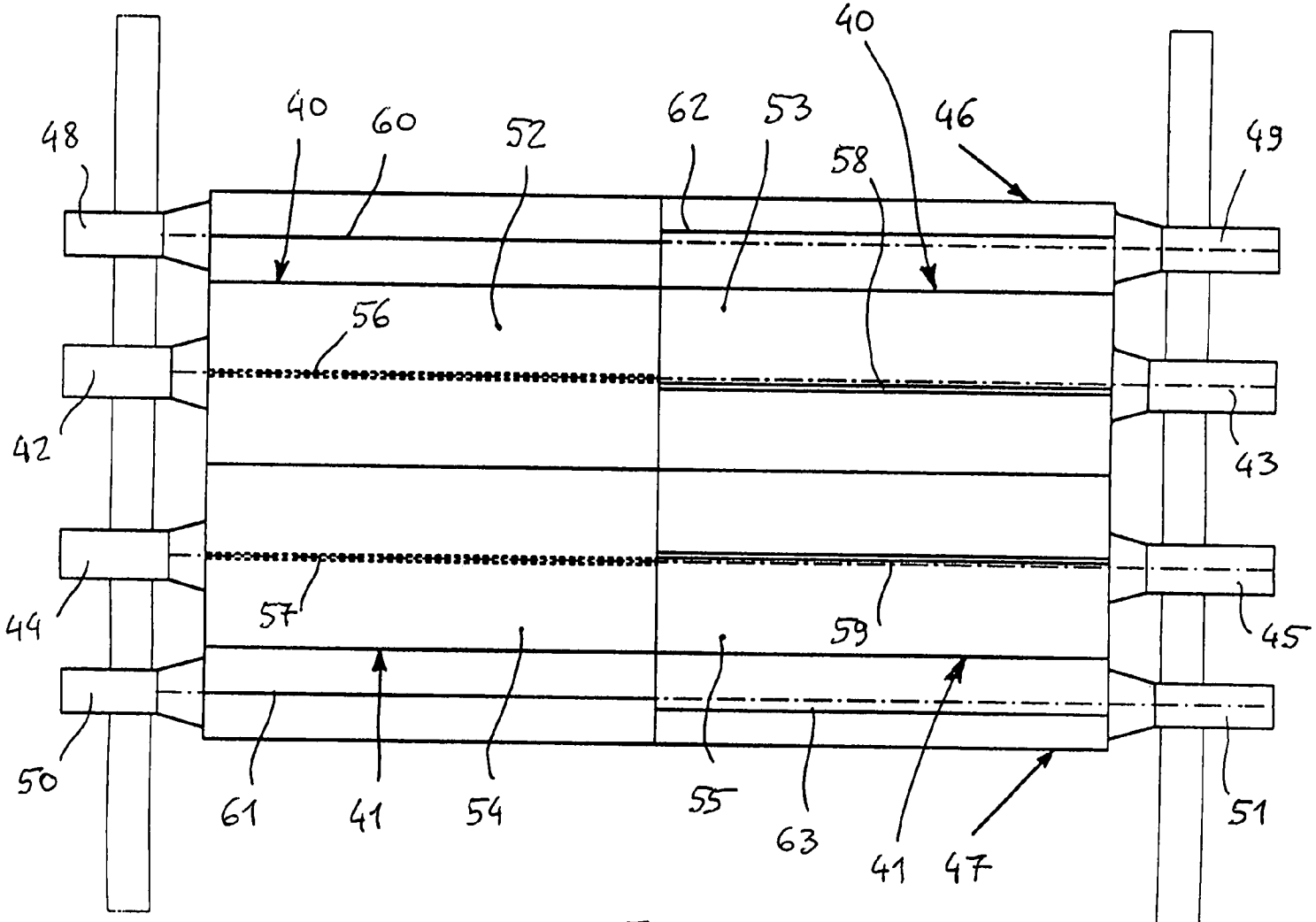
FIG. 9 shows a schematic front view of some component parts of the printing device in accordance to the invention.

According to the invention, it is obviously possible to arrange the magnetic cores also on different positions than those described by way of example only, for example also in the interior of at least one of the cylinder-plates provided that the effect of reciprocal attraction among the different cylinders of the printing machine is always obtained in the same manner and for the same functions. The FIG. 9 shows a pair of metallic printing cylinders 40 and 41 covered with caoutchouc, having double height, which are identical and made with a large diameter, like that of the cylinders mounted on the current printing machines.

These printing cylinders are disposed parallel to each other in the horizontal direction and into reciprocal contact at the central zone thereof, in which the printing process of the paper pages and sheets being passing through the same zone occurs, said printing cylinders being supported by means of relative side shafts 42, 43 and 44, 45 on to the support structure (not shown) of the printing machine and driven in rotation by means of transmission mechanisms of conventional type (not shown), with rotation directions opposite to each other and rotation speeds of about 40,000 rpm. Moreover, the same Figure makes it visible a pair of metallic cylinder-plates 46 and 47, which are supported by means of relative side shafts 48, 49 and 50, 51 on the the printing machine support structure, on a position opposite to and into close reciprocal contact with the associated printing cylinder 40 and 41 and this contact is obtained by utilizing the thrust mechanisms associated with the above mentioned transmission mechanisms and the magnetic means.

Figure 10:
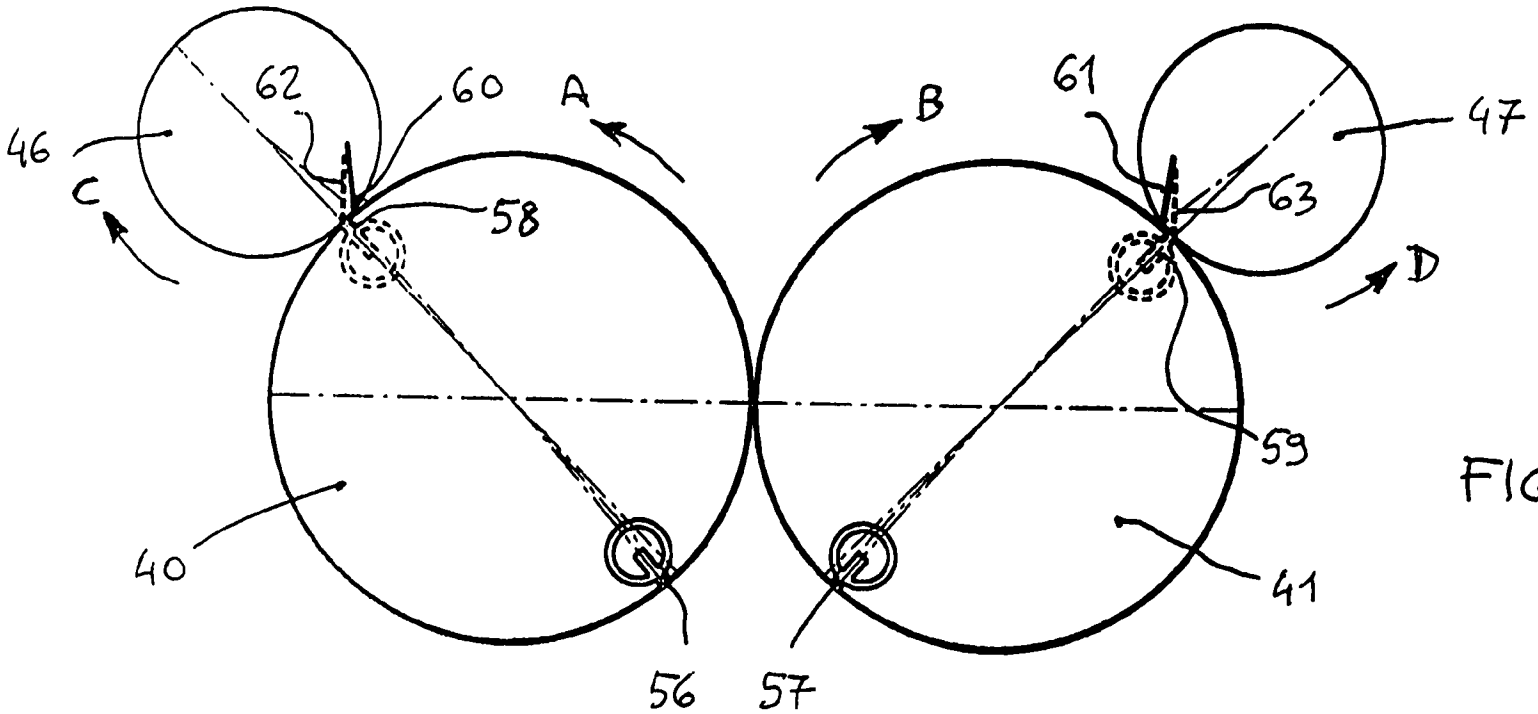
FIG. 10 shows a sidewise view of the component parts of the printing device of FIG. 9, displaced in an operative position thereof.
Figure 11:
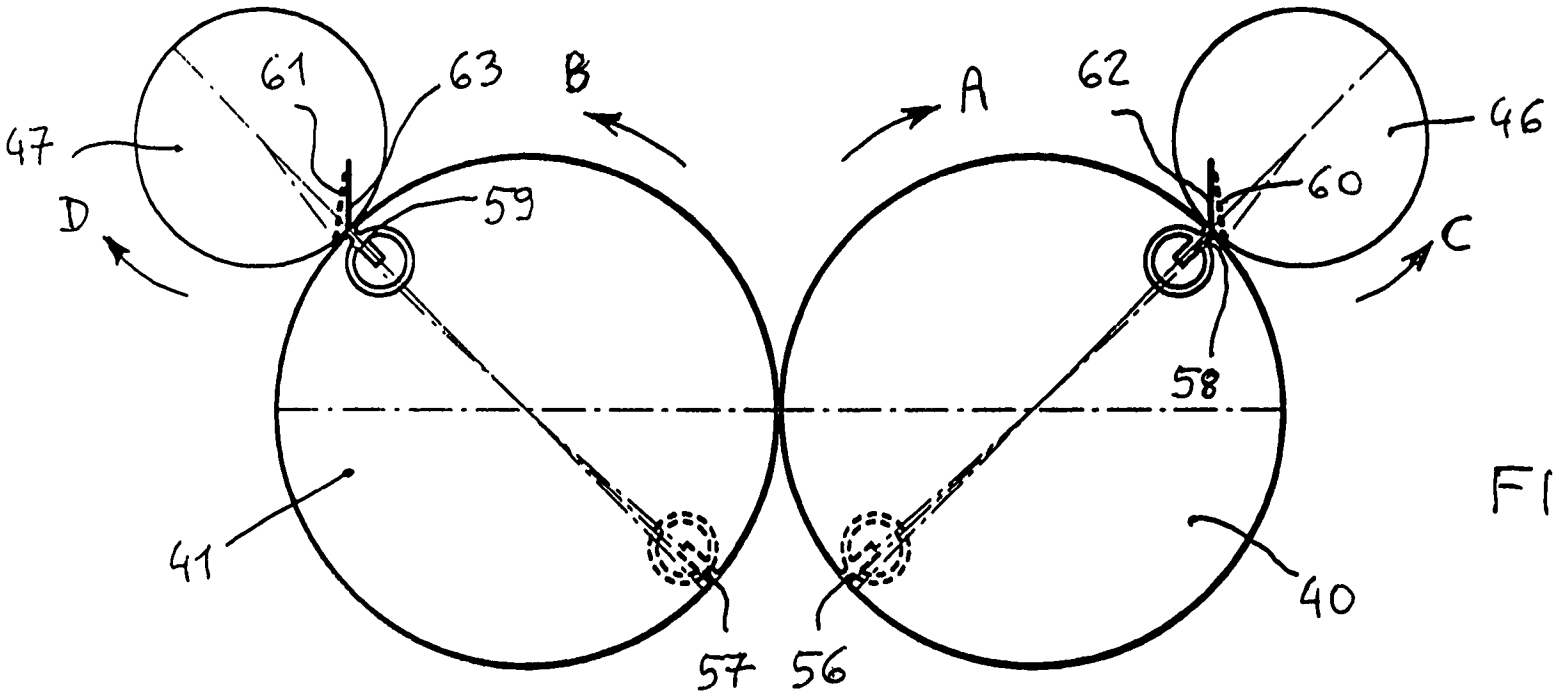
FIG. 11 shows a sidewise view from the other side of the component parts of the printing device of FIG. 9, displaced in the same operative position of FIG. 10.

In the Figure referred to, in which all the remaining rollers of the printing machine aren't illustrated, the covering of caoutchouc of the printing cylinders 40 and 41 is made, as already described previously, with two respective portions 52, 53 and 54, 55 which are identical with each other and extend for a lenght equal to a half-lenght of the entire covering, and these covering portions 52, 53 and 54, 55 are applied on to the corresponding cylinders by hooking the free ends of a relative portion 52, 54 into a corresponding groove 56 and 57, provided for a half-lenght of the same cylinders, and the free ends of the other relative portion 53 and 55 into a relative groove 58 and 59 provided for the other half-lenght of such cylinders, wherein the grooves of each cylinder are offset angularly from each other along the outer surface of the same cylinder, and preferably with an angle of about 180°. Moreover, according to the invention, also the cylinder-plates 46 and 47 are provided externally with a relative pair of grooves 60 and 61 for a complete half-lenght of such cylinders and a relative pair of grooves 62 and 63 for the other half-lenght of the same cylinders, and these grooves are provided for applying corresponding printing plates, the end portions of which are inserted into the same grooves. Also in this case, the grooves of each cylinder are offset angularly from each other along the outer surface of the same cylinder, and preferably of an angle of about 184°, measured on a circular direction of such outer surface and of about 176° measured on the opposite circular direction of the same outer surface. As visible from FIGS. 10 and 11, in which there are shown the printing cylinders 40 and 41 and the cylinder-plates 46 and 47 with respective views from one side and from the other side, it is noted that during the printing cylinders rotation in the respective directions A and B, and therefore also of the cylinder-plates in the relative directions C and D, when the relative grooves of a half-lenght of the cylinder-plates come into contact with the opposite grooves of the corresponding half-lenght of the printing cylinders, the grooves of the other half-lenght of the cylinder-plates are moved away and not into contact with respect to the grooves of the printing cylinders, while also the grooves of each printing cylinder come into contact only with a single groove of the other printing cylinder. In this way, thanks to these reciprocal arrangement of the grooves of the printing cylinders and the cylinder-plates, the continuous contact among all these cylinders occurs in a soft manner with minima vibrations and mechanical stresses, which would be higher if the grooves come into contact entirely with each other, with consequent considerable improved performances of the printing machines.

Figure 12:
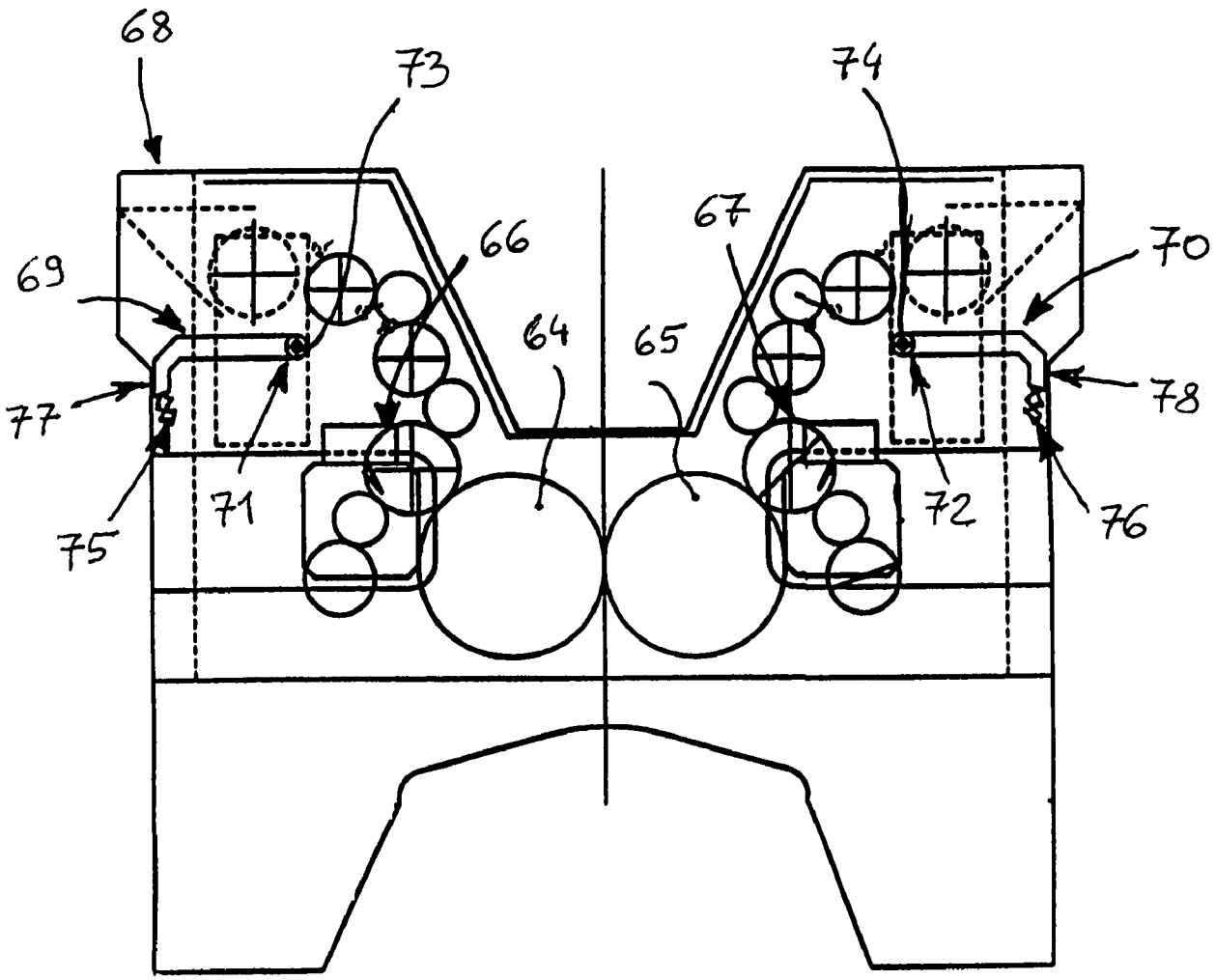
FIG. 12 shows a schematic front view of some component parts of the printing device in accordance to the invention, fitted on a printing machine and displaced in an operative position thereof.
Figure 13:
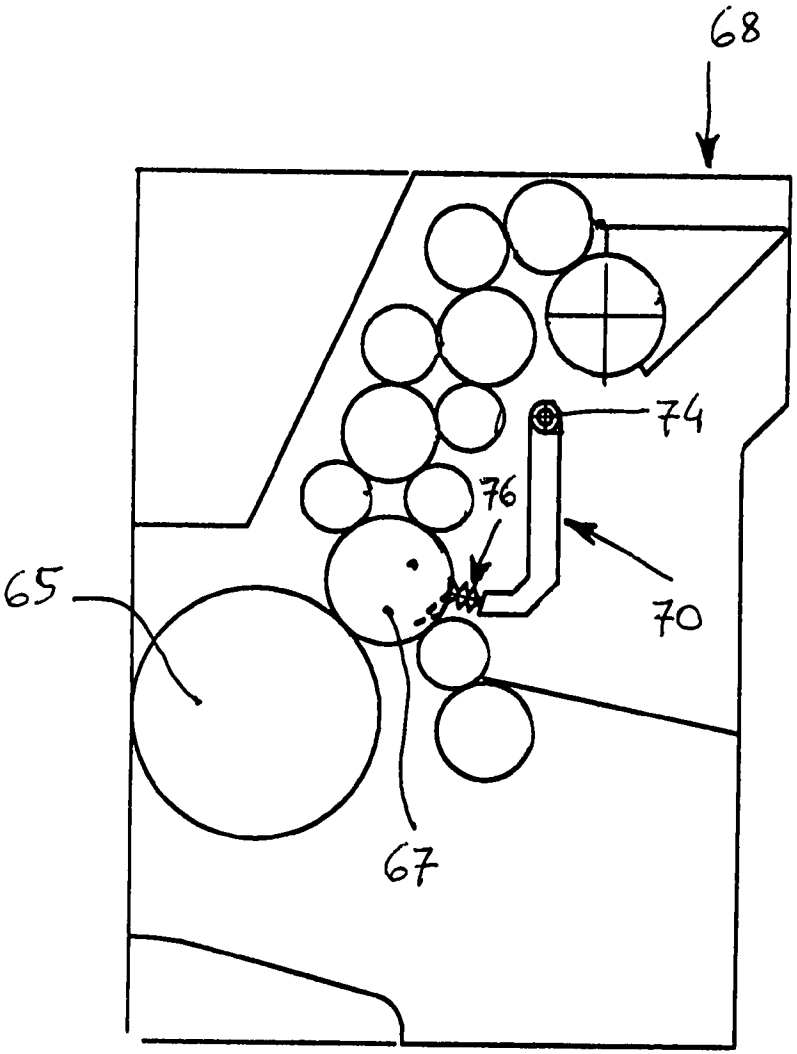
FIG. 13 shows a front view of the component parts of FIG. 12, displaced in another operative position thereof.
Figure 14:
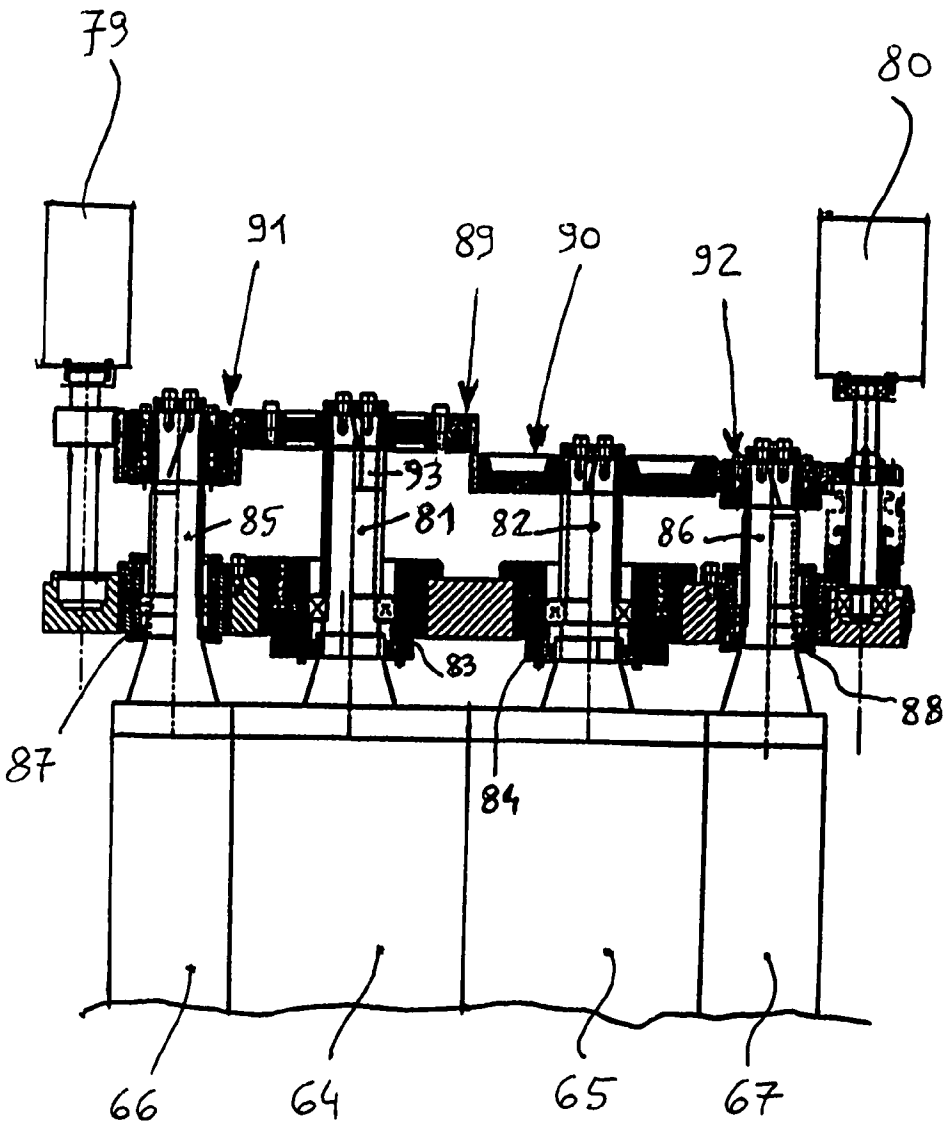
FIG. 14 shows a schematic plan view of other component parts of the printing device of FIG. 12, fitted on a printing machine and displaced in an operative position thereof.
Figure 15:
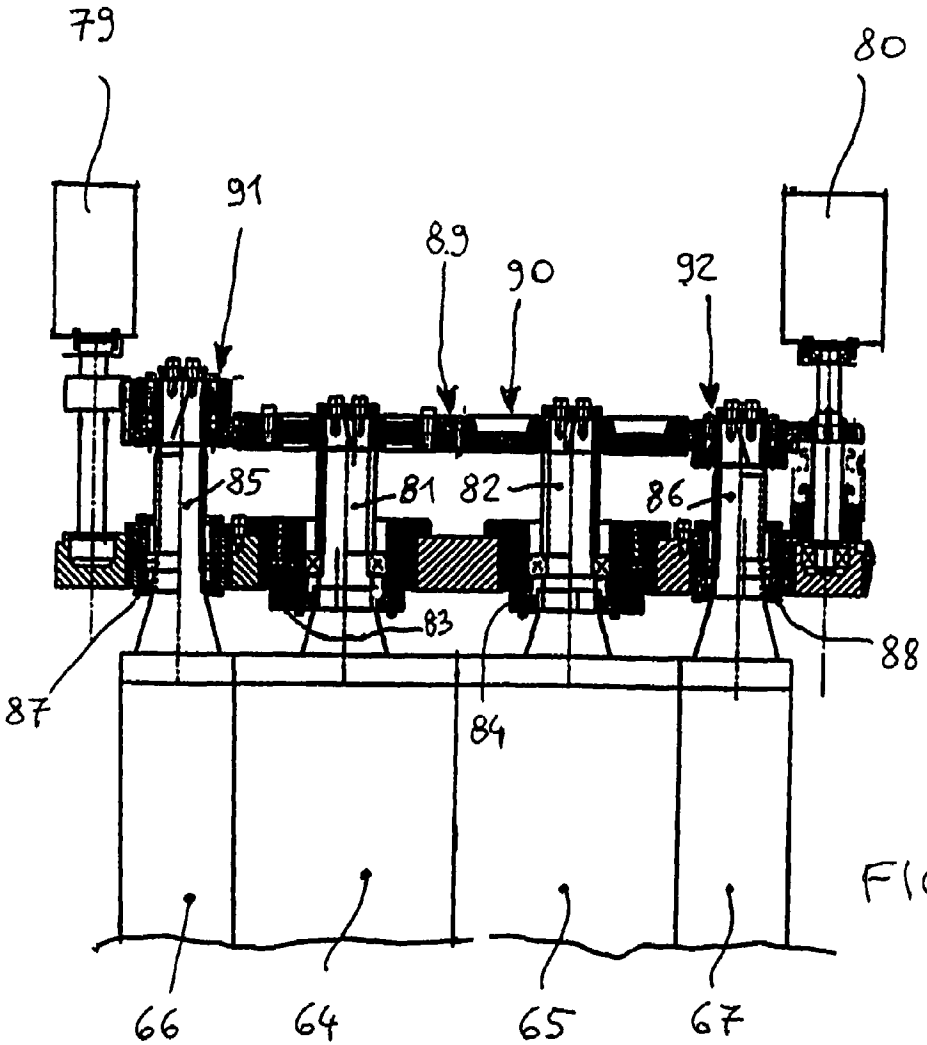
FIG. 15 shows with the same view of FIG. 14 the component parts displaced in another operative position thereof.
Figure 16:
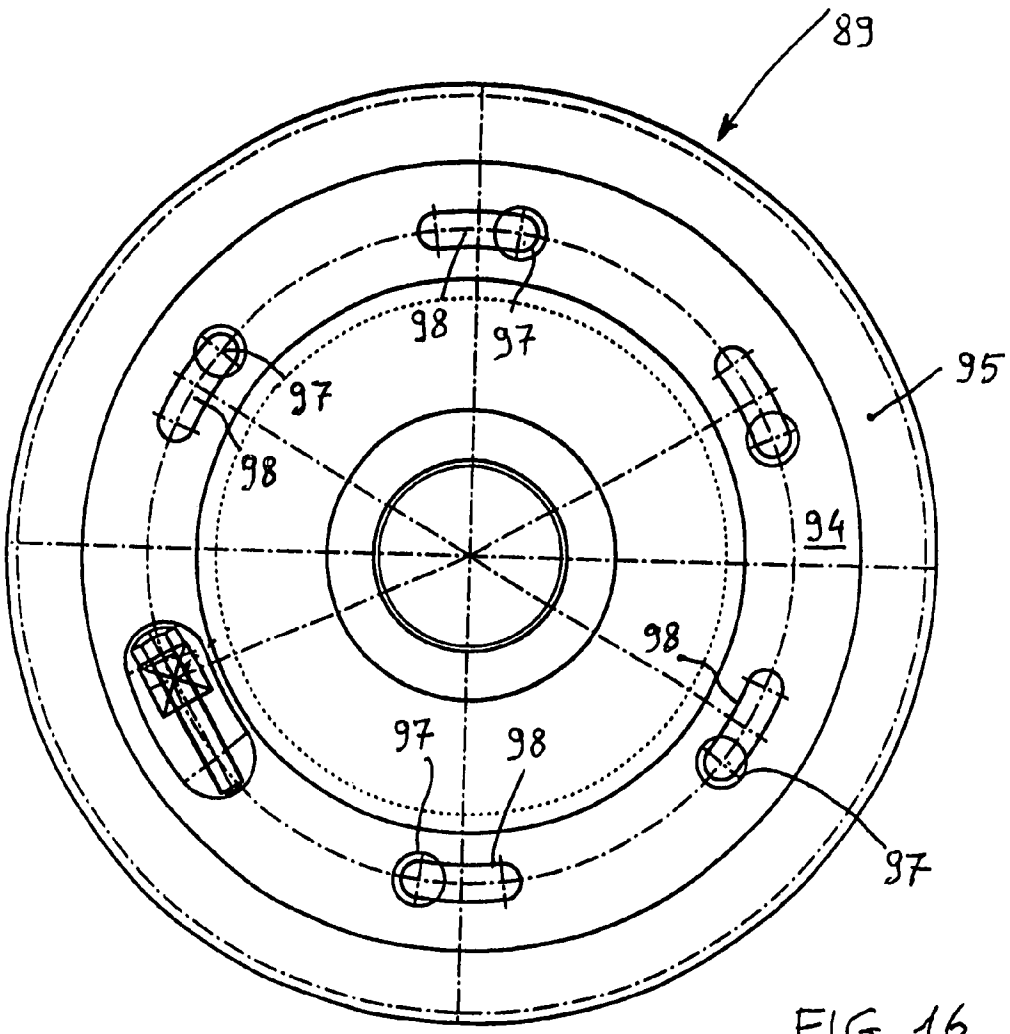
FIGS. 16 and 17 show a respective cutaway front and side view of a constructive item of the component parts of both FIGS. 14 and 15.
Figure 17:
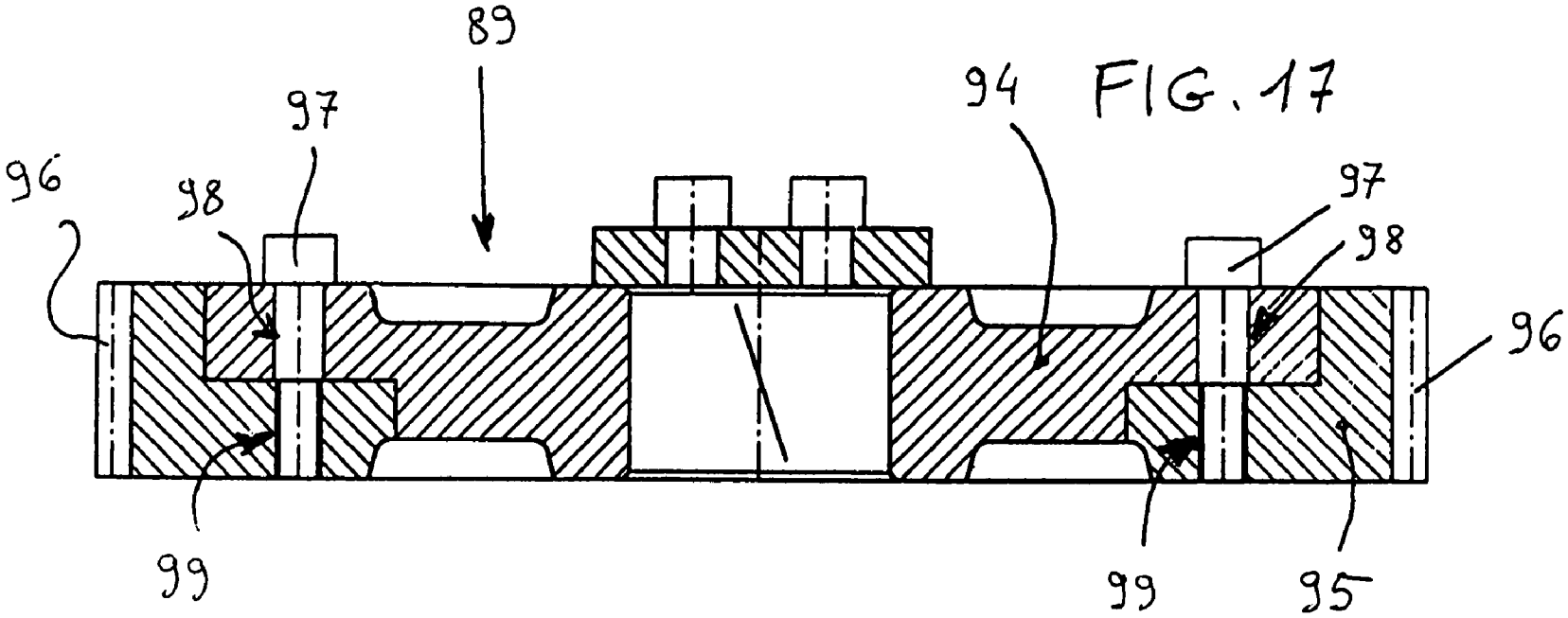

The FIGS. 12–17 schematically illustrate the same above mentioned printing machine, the printing device of which also includes the component parts according to the invention, which will be described in detail hereinafter. In the FIGS. 12 and 13, in particular, it is described one of these component parts, while in the FIGS. 14–17 there is described another one of these component parts. With reference to FIG. 12, it is noted that the printing machine substantially comprises always the same pair of caoutchouc-covered printing cylinders 64 and 65 and the pair of metallic cylinder-plates 66 and 67, which are all supported by the machine supporting structure 68. In the Figure referred to, it is noted that the first component part included in the printing machine is substantially constituted by a series of movable levers 69 and 70 identical to each other and articulated at a first end portion 71 and 72 thereof on a corresponding lenghtened stud 73 and 74, arranged parallel to the relative cylinder-plate 66 and 67 and spaced away therefrom, as well as supported at its end portions on to the machine supporting structure 68, said levers being articulated on the respective lenghtened stud 73 and 74 for the entire lenght thereof, and for the entire lenght of the cylinder-plate respectively opposite to such stud, and being also spaced away from each other in such a manner to be arranged on positions corresponding to the applying positions of the printing plates on to the associated cylinder-plates. These movable levers 69 and 70 are associated with respective suction means formed by at least a corresponding suction cup 75 and 76 or the like, secured to the relative free end portion 77 and 78 of the same levers, and connected with a suitable pneumatic system (not shown), adapted to generate or not generate a depression in the interior of such suction cups, so as to provide or not provide for a suction action of the same suction cups for the reasons which will be described later on. Moreover, these movable levers 69 and 70 can be displaced contemporaneously, by a limited rotation of the associated stud 73 and 74, from a starting rest position thereof shown on FIG. 12, in which all the levers are rotated upwards on a position moved away laterally from the relative cylinder-plates, and therefore also from the printing plates applied on to said cylinder-plates, in which condition all the suction cups secured to said levers are also moved away upwards with respect to such cylinder-plates and printing plates, to a working position shown on FIG. 13 in which all the levers are rotated downwards, on a position approached laterally to the relative cylinder-plate and the printing plates applied on to said cylinder-plates. Then, on this working position all the suction cups 75 and 76 of such levers are arranged into contact against the outer surface of the different printing plates applied on to said cylinder-plates, so as to adhere closely against the same outer surface when a depression in the suction cups is generated. The object of this first component part is that to allow the printing plates to be automatically detached without manual actions from the relative cylinder-plate on to which they are applied, and to allow a possible replacement of the detached plates with plates of other kind and with a different composition of the types. To this aim, all the levers 69 and 70 are initially displaced on the raised rest position thereof of FIG. 12, in which condition all the printing plates applied in advance on to the corresponding cylinder-plates provide for printing the needed number of copies, and in which all the suction cups 75 and 76 are moved away from such printing plates and are kept inactive. When the printing operation is ended and the replacement of one or more printing plates is needed, the rotation of the printing cylinders and the cyliner-plates is stopped, while all the levers 69 and 70 are displaced contemporaneously on their working position of FIG. 13, in which all the suction cups 75 and 76 are arranged into contact against the outer surface of such printing plates. Then, under this condition a depression in the suction cups is generated, with consequent close adhesion thereof against the various printing plates, while the printing cylinders and the cylinder-plates are always driven in rotation for a short time and with a low rotation speed, and all the levers 69 and 70 are displaced contemporaneously on their rest position, together with the suction cups being adherent against the relative printing plates. As a consequence, as soon as such cylinders are rotating the printing plates are progressively detached from the respective cylinder-plates and, at the end of a complete rotation of the cylinder-plates, such printing plates are completely detached from the relative cylinder-plate. Then, under this condition, all the suction cups are inactivated again, with consequent detachment of the plates from the same suction cups and applying of further printing plates on to the relative cyilinder-plates. With reference now to the FIGS. 14–17, shown therein is the second component part according to the invention, which is substantially constituted by a transmission mechanism of the movement of different printing cylinders and cylinder-plates, which is made in the manner and for the scopes which will be described later on. This movement transmission mechanism is connected to such printing cylinders and cylinder-plates and is driven in rotation by at least two electric motors 79 and 80, supported on the machine supporting structure 68 and controlled contemporaneously so as to drive in rotation all the above mentioned cylinders during each printing cycle. As visible from FIG. 14, in which there are noted the printing cylinders 64 and 65 which are supported on the supporting structure 68 by means of suitable shafts 81 and 82 and bearings 83 and 84, and the cylinder-plates 66 and 67 which are supported on said supporting structure by means of respective shafts 85 and 86 and bearings 87 and 88, such transmission mechanism is substantially constituted by a series of gearwheels 89, 90, 91 and 92, adequately meshing to each other and receiving the rotation movement from both the electric motors, and which are fixed on the respective shafts of the printing cylinders 64 and 65 and the cylinder-plates 66 and 67. In particular, while the gearwheels 90 and 92 driving respectively the printing cylinder 65 and the cylinder-plate 67 are steadily meshing together, the remaining gearwheels 89 and 91 can be moved, in the manner and for the scope which will be described later on, from a first operative position thereof in which they are meshing steadily together (see FIG. 14), but aren't meshing with the other gearwheels 90 and 92, to a second operative position thereof in which they are always meshing steadily together (see FIG. 15) and are also meshing with the other gearwheels 90 and 92. In order to allow these gearwheels to be moved from the above mentioned first to the second operative position thereof, and vice versa, the gearwheel 91 is made with a height larger than that of the gearwheel 89, while this latter may slide axially from the one to the other one of its operative positions along a groove 93 provided on the terminal portion of the shaft 81 supporting the printing cylinder 64, for such a depth as that when such gearwheel 89 is moved to its second operative position, it is arranged flushing to and meshing with respect to the adjacent gearwheel 90 which drives the printing cylinder 65, and is also still meshing with the gearwheel 91 thanks to the larger height of this latter. Furthermore, after each displacement of the gearwheel 89 in the relative operative position, such gearwheel is secured properly and kept on this position. In this way, thanks to the fact to maintain the axially movable gearwheel 89 always engaged with the associated gearwheel 91 on both the operative positions thereof, it is possible to provide always the movement transmission from the electric motors 79 and 80 to all the printing cylinders and cylinder-plates, and in particular on the first operative position this movement is determined by the electric motor 79 through the gearwheels 91 and 89, which cause the rotation of the cylinder-plate 66 and the printing cylinder 64, as well as by the electric motor 80 through the gearwheels 92 and 90 which cause the rotation of the cylinder-plate 67 and the printing cylinder 65. This is the normal operative condition of the machine, where all the cylinders are driven in rotation by both the electric motors 79 and 80. In turn, on the second operative position the movement is determined either by the electric motor 79 or by the electric motor 80 only, and is transmitted to all the printing cylinders and cylinder-plates, through all the gearwheels which are always meshing together. This operative condition, which is an anomalous condition, could occur in case of an operative breakdown or failure of any one of the two driving electric motors, so that also in this case it is possible to ensure always a correct machine operation, which circumstance on the contrary could not be possible to achieve on the current printing machines provided with two motors and not provided of the just described system. In fact, any breakdown or failure of one motor on the current machines with two motors involves unavoidably the stop of printing process. Finally, FIGS. 16 and 17 show a regulating device associated with the gearwheel 89, adapted to allow the correction of the angular position of the same gearwheel with respect to that of the printing cylinders and the corresponding cylinder-plates, in the case in which such gearwheel 89 is moved on the second operative position thereof (see FIG. 15), owing to any operative breakdown or failure of one of the two electric driving motors. To this aim, the gearwheel 89 is provided with a first and a second parts 94 and 95, separated and cooperating with each other, and shaped in such a manner that the first part 94, where the driving shaft 81 of the printing cylinder 64 is housed and secured, is housed internally the second part 95, on a position overlapped thereon, and that the second part 95 be provided with the outer toothing 96 steadily meshing the corresponding toothings of the adjacent gearwheels 91 and 90. In this way, such gearwheel parts 94 and 95 may be displaced rotatably from each other, so that to provide for regulating the angular position of the gearwheel 89, under correction also of the angular position of the printing cylinders with respect to the corresponding cylinder-plates, and therefore resetting the correct printing. This regulation can be done by providing a regulating device constituted by a series of vertical bolts 97 or the like, co-operating with the associated adjustment screw and inserted through corresponding through slots 98 of the firs gearwheel part 94, which are adequately spaced away angularly with each other, and a series of corresponding threaded holes 99 provided through the second gearwheel part 95, on positions corresponding to those into which the different bolts 97 are inserted. This regulation is effected by unscrewing temporarily all the bolts, and thereafter by rotating the first gearwheel part 94 with respect to the second gearwheel part 95, up to displace it on the correct angular position where all the cylinders are displaced in a manner to attain a perfect printing, with consequent corresponding angular displacement of all the bolts along the associated through slots, and finally by tightening the bolts so as to secure tightly the two gearwheel parts 94 and 95 together. Instead of in the described manner, it is also possible to arrange the component parts as described on different positions in order to achieve always the same effects, thus without departing from the protection sphere of the present invention.

What is claimed is:

1. Printing device for printing machines of various kind, and particularly but not exclusively offset printing machines, adapted to print also with colors paper pages and sheets of any size, wherein the printing machines comprise a plurality of cylinders of the same length, supported on a rigid supporting structure and driven in rotation by means of transmission means, said cylinders including one or more caoutchouc-covered printing cylinders co-operating with cylinder-plates of conventional type, on to which the printing plates are applied, and with possible applying means for the ink and the printing aqueous solution, the device being characterized in that said printing cylinders (10, 11) and said cylinder-plates (16, 17) are made with at least a double height and that there are provided magnetic means (23) associated with said printing cylinders (10, 11) and said cylinderplates (16, 17), said magnetic means (23) being adapted to be magnetized during the printing process, so as to keep a reciprocal attraction among said printing cylinders (10, 11) and said cylinder-plates (16, 17) for the entire printing process duration, and adapted to be de-magnetized at the end of the printing process, said magnetic means (23) being made in such a way as to permit them to be magnetized and de-magnetized at pre-established intervals by means of electric control means connected thereto.

2. Printing device according to claim 1, characterized in that said printing cylinders (10, 11) comprise a pair of cylinders into reciprocal contact arrangement, and said cylinder-plates (16, 17) are arranged into contact of a printing cylinder (10, 11) respectively opposite thereto.

3. Printing device according to claim 1, characterized in that said printing cylinder is a central cylinder (34) acting as an abutment, and characterized by a first, a second, a third and a fourth cylinder (16*d, e* and 17*d, e*) shaped like plate carrying cylinders with engraved writings, which are distributed into a satellite-like arrangement around said printing cylinder (34), and are offset from each other and arranged into contact of said central cylinder (34) and provided for the black and white printing and the color printing with the three main colors red, yellow and blue, and also into contact of corresponding anilox cylinders made of ceramic, said central printing cylinder (34) being also arranged into contact or slightly moved away with respect to a further idle rotating cylinder (35) so as to magnetize or de-magnetize thereof.

4. Printing device according to claim 3, characterized in that said first, second, third and fourth cylinders (16, *d, e* and 17*d, e*) are arranged into contact of opposite printing cylinders (36, 37, 38, 39), which in turn are into contact with said central cylinder (34).

5. Printing device according to claim 3, characterized in that said magnetic means comprise at least a magnetic device (23) so shaped and dimensioned as to be inserted into a corresponding inner cavity (22) of said printing cylinders (10, 11) or said idle rotating cylinder (35), on a position below the covering of caoutchouc of the same cylinders, said magnetic device (23) being provided with at least an electric coil (24) to magnetize and de-magnetize thereof, which is connected to said control means with electric conductors through a rotating conductor device (29) for example a mercury device, associated with each printing cylinder (10, 11) or said idle rotating cylinder (35).

6. Printing device according to claim 5, characterized in that said magnetic device (23) is made with a magnetic core of magnetic material and preferably an electro-permanent material, said magnetic core (23) being made like a lengthened cylindrical block (25) housed centrally into said inner cavity (22) and shaped with at least a pair of polar shoes (26, 27) of different polarities, spaced away axially from each other, for housing said coil (24) with the interposition of an annular part (28) of diamagnetic insulating material.

7. Printing device according to claim 6, characterized in that the covering of caoutchouc of each printing cylinder (10, 11) or further cylinder (35) is made by dividing the length of said covering into two identical portions, a first and a second portion, and by hooking the free ends of said first portion into a corresponding groove (30, 32) provided externally said cylinders (10, 11) or said idle rotating cylinder (35), for a length portion thereof, and the free ends of said second portion into a corresponding groove (31, 33) provided externally the same cylinders or said further cylinder, for another length portion thereof, and offset of almost 180° with respect to the preceding groove.

8. Printing device according to claim 1, characterized in that each cylinder-plate (16, 17) is covered with a number of plates identical to the number of pages and sheets to be printed.

9. Printing device according to claim 1, characterized in that said cylinder-plates (46, 47) are provided externally with a relative pair of grooves (60, 61) for a complete half length of such cylinders, and a relative pair of grooves (62, 63) for the other half length of the same cylinders, for applying the corresponding printing plates, whose end portions are inserted into the same grooves, said grooves (60, 61; 62, 63) being provided on such positions as to come into contact of a single groove of the corresponding printing cylinders (40, 41), during the rotation of these latter and said cylinder-plates (46, 47).

10. Printing device according to claim 9, characterized in that the grooves of each cylinder-plate (46, 47) are offset angularly from each other along the outer surface of the same cylinder, and preferably of an angle of about 184° measured on a circular direction of such outer surface and of about 176° measured on the opposite circular direction of the same outer surface.

11. Printing device according to claim 1, wherein said cylinders are driven in rotation through at least two powered means (electric motors 79, 80), characterized in that said cylinder-plates (66, 67) are associated with movable catching means (69, 70), co-operating with said printing plates to provide for the automatic detachment thereof from the relative cylinder-plate solely when the replacement thereof is needed, and that said transmission means (89–92) are made in such a way that during the printing process the rotation of all said cylinders is controlled with both said powered means (79, 80) and with either one of the same powered means, in the case of any possible operative breakdown or failure of one of said powered means.

12. Printing device according to claim 11, characterized in that said movable catching means comprise a plurality of first and second movable levers (69, 70), articulated at a first end portion (71, 72) thereof on a corresponding lengthened stud (73, 74), arranged parallel to and spaced away from the corresponding cylinder-plate (66, 67) and supported at its end portions on to the machine supporting structure (68), said first and second movable levers (69, 70) being articulated for the entire length of the respective lengthened stud (73, 74) and the entire length of the cylinder-plate respectively opposite thereto, and being also spaced away from each other in such a manner to be arranged on positions corresponding to the applying positions of said printing plates on to the associated cylinder-plates, said first and second movable levers (69, 70) being associated with pneumatically operated catching means (suction cups 75, 76) and being displaceable from a first to a second operative position, and vice versa, in which they are respectively moved away and approached with respect to said printing plates, respectively when the replacement of these printing plates isn't required, during the printing process, and when it is required at the end of the printing process, said catching means (suction cups 75, 76) being arranged for being activated when said movable levers (69, 70) are displaced on said second operative position thereof, with consequent catching action on to the printing plates to be detached, and for being deactivated when said first and second movable levers (69, 70) are displaced on said first operative position thereof, with said printing plates which are attached, and when said printing plates have been detached from the relative cylinder-plates, after a complete rotation of these latter with a low rotation speed.

13. Printing device according to claim 11, wherein said transmission means comprise a series of gearwheels (89, 90, 91, 92) to provide for the rotation of said printing cylinders (64, 65) and said cylinder-plates (66, 67), characterized in that a first gearwheel (89) is shaped movable axially from a first operative position, in which the movement transmission occurs through both said powered means (79, 80), to a second operative position in which the movement transmission occurs through either one of said powered means (79, 80).

14. Printing device according to claim 13, characterized in that said first gearwheel (89) is meshing a third gearwheel (91), which is made with a height larger than its height, said first gearwheel (89) being kept engaged with said third gearwheel (91) when it is displaced on both said first and second operative positions thereof, and being engaged also with a second and a fourth gearwheel (90, 92), steadily engaging together, solely when it is displaced on its second operative position.

15. Printing device according to claim 13, characterized in that said first gearwheel (89) is made with a first and a second part (94, 95), separated and cooperating with each other, of which said first gearwheel part (94) is secured to the associated printing cylinder (64) and said second gearwheel part (95) is provided with the outer toothing (96), said first and second gearwheel parts (94, 95) being displaceable angularly from each other, to provide for the adjustment of the angular position of said first gearwheel (89), so as to correct also the angular position of said printing cylinders (64, 65) with respect to the corresponding cylinder-plates (66, 67) and by resetting the correct printing operation.

16. Printing device according to claim 15, characterized in that said first and second gearwheel parts (94, 95) are provided with fixing means (97) for securing together the same parts, at any adjustment position respectively attained.

* * * * *